US008220686B2

(12) United States Patent
Kestner et al.

(10) Patent No.: US 8,220,686 B2
(45) Date of Patent: Jul. 17, 2012

(54) ACTUATOR PIN GUIDE FOR A FASTENER DRIVING TOOL

(75) Inventors: Kyle Kestner, Schaumburg, IL (US); Mike Popovich, Bartlett, IL (US)

(73) Assignee: Illinois Tool Works Inc., Glenview, IL (US)

( * ) Notice: Subject to any disclaimer, the term of this patent is extended or adjusted under 35 U.S.C. 154(b) by 584 days.

(21) Appl. No.: 11/879,313

(22) Filed: Jul. 17, 2007

(65) Prior Publication Data

US 2009/0020583 A1 Jan. 22, 2009

(51) Int. Cl.
*B25C 1/04* (2006.01)

(52) U.S. Cl. ..... 227/10; 227/8; 227/130; 227/119; 227/156; 123/46 SC

(58) Field of Classification Search ..... 227/8, 10, 227/130, 119, 156; 123/46 SC
See application file for complete search history.

(56) References Cited

U.S. PATENT DOCUMENTS

| | | | | |
|---|---|---|---|---|
| 3,011,169 | A * | 12/1961 | Cast et al. | 227/8 |
| 3,606,128 | A | 9/1971 | Cast et al. | |
| 3,809,307 | A * | 5/1974 | Wandel et al. | 227/8 |
| 4,403,722 | A | 9/1983 | Nikolich | |
| 4,483,280 | A | 11/1984 | Nikolich | |
| 4,483,474 | A | 11/1984 | Nikolich | |
| 4,522,162 | A | 6/1985 | Nikolich | |
| RE32,452 | E | 7/1987 | Nikolich | |
| 5,263,439 | A | 11/1993 | Doherty et al. | |
| 5,647,525 | A * | 7/1997 | Ishizawa | 227/113 |
| 6,138,887 | A * | 10/2000 | Nayrac et al. | 227/8 |
| 6,164,510 | A | 12/2000 | Deieso et al. | |
| 6,641,021 | B2 | 11/2003 | Jablonski | |
| 6,892,922 | B2 | 5/2005 | Tucker et al. | |
| 7,097,083 | B2 | 8/2006 | Kolodziej et al. | |
| 2006/0011693 | A1 * | 1/2006 | Wywialowski et al. | 227/109 |
| 2008/0223898 | A1 * | 9/2008 | Rouger et al. | 227/8 |
| 2008/0314951 | A1 * | 12/2008 | Kosuge et al. | 227/10 |
| 2009/0001119 | A1 * | 1/2009 | Osuga | 227/10 |

FOREIGN PATENT DOCUMENTS

| | | | |
|---|---|---|---|
| EP | 1 647 365 | | 4/2006 |
| WO | WO 2006123693 | A1 * | 11/2006 |
| WO | WO 2007/018179 | | 2/2007 |

* cited by examiner

*Primary Examiner* — Brian D Nash
*Assistant Examiner* — Michelle Lopez
(74) *Attorney, Agent, or Firm* — Greer, Burns & Crain, Ltd.; Patty Chidiac; Mark W. Croll

(57) ABSTRACT

In a fastener-driving tool equipped with a fastener magazine, and a power source including a reciprocating driver blade for driving fasteners obtained from the magazine into a workpiece, and a reciprocating valve sleeve actuated by a cage, a nosepiece is provided, including a nosepiece body configured for attachment at one end to the fastener tool and defining a fastener channel constructed and arranged for receiving the driver blade and the fasteners sequentially fed by the magazine, the fastener channel having a fastener outlet. A unitary actuator reciprocates relative to the nosepiece body, has a first end contacting the workpiece, and a second end engaging the cage.

15 Claims, 7 Drawing Sheets

ACTUATOR PIN GUIDE FOR A FASTENER DRIVING TOOL

BACKGROUND

The present invention relates generally to portable fastener driving tools. More specifically, embodiments of the present invention relate to nose assemblies for such tools.

Portable fastener driving tools are typically powered by pneumatic, combustion, electric, or powder systems, and nose assemblies according to embodiments of the present invention are contemplated for use on portable fastener driving tools regardless of the power system. However, exemplary embodiments described herein will refer to combustion-powered tools.

Portable combustion-powered fastener driving tools, such as those manufactured by ITW Paslode under the IMPULSE® brand, and those manufactured by ITW Ramset under the TRAKFAST® brand, are utilized for driving fasteners into workpieces or substrates. An example of a portable combustion-powered fastener driving tool is described in commonly-assigned U.S. Pat. No. 6,164,510, the contents of which are incorporated by reference.

Such tools incorporate a tool housing enclosing a small internal combustion engine. The engine is powered by a canister of pressurized fuel gas called a fuel cell. A battery-powered electronic power control unit produces the spark for ignition. A fan located in a combustion chamber both provides for an efficient combustion within the chamber and facilitates scavenging, including the exhaust of combustion by-products.

The engine includes a reciprocating piston having an elongate, rigid driver blade reciprocating inside a cylinder. A valve sleeve is axially reciprocal about the cylinder and, through a linkage, moves to close the combustion chamber when a work contact element (WCE) at the end of the linkage is pressed against a workpiece or substrate. This pressing action also triggers a fuel metering valve to introduce a specified volume of fuel into the closed combustion chamber.

Upon the pulling of a trigger switch, which causes the ignition of a gas/air mixture in the combustion chamber, the piston and driver blade are driven down the sleeve. Fasteners are fed from a magazine to a nosepiece where they are held in a properly positioned orientation for receiving the impact of the driver blade. A leading end of the driver blade engages a fastener and drives it along a channel defined by the nosepiece into the substrate. The channel is defined by upper and lower guide members of the nosepiece. Next, the piston and driver blade are returned to the original, pre-firing ("ready") position by differential gas pressures within the cylinder.

The nosepiece and WCE typically include a number of precision parts, the forming and assembly of which can add significantly to the cost of tool production, operation and maintenance. It is desired for these parts to be formed and assembled precisely, for example, to ensure proper alignment and provide a clear path for the driver blade and fastener. Otherwise, jamming of the fastener may result.

Fasteners used with such fastener driving tools include nails designed to be forcibly driven into wood and drive pins designed to be forcibly driven into concrete or masonry. Typically, in such drive pins, the shank has a portion flaring outwardly where the shank adjoins the head. An exemplary use of such drive pins is for attaching metal channels, which are used to mount plasterboard walls, or other metal workpieces to concrete substrates.

Many fastener-driving tools require such fasteners to be fed in strips, in which the fasteners are collated, through magazines having mechanisms for feeding the strips of collated fasteners. Commonly, such fasteners are collated via carriers molded from polymeric materials, such as polypropylene, with individual sleeves, bushings, or holders for the respective fasteners, and with frangible bridges between successive sleeves, bushings or holders.

Specifically, conventional fastener tool nosepieces of the type used with such collated fasteners or drive pins are disclosed in U.S. Pat. No. 6,641,021, which is incorporated by reference, typically include a tubular WCE which extends upward into the nosepiece and includes a laterally opening slot for sequentially receiving collated pins fed from a magazine. In some cases, pins or the molded sleeves carrying the pins become misaligned in the slot and subsequently jam in the WCE.

Additionally, these types of fastener driving tools absorb considerable shock and vibration during and after each actuation (firing). Further, the impact forces generated after fastener driving cause the tool to be propelled away from the fastener as it is driven into the workpiece/substrate. Recently, framing tools have become more powerful to satisfy operator needs. These enhanced forces put large stresses on many parts of the tool, which may cause more rapid wear of the nosepiece and/or the WCE. Extended wear to the nosepiece also may cause the tubular WCE to break or warp. Besides the cost of repair, such malfunctions result in tool downtime, which is exacerbated by the relatively complex nosepiece assembly.

Another design factor in such tools is that upon ignition of the gas/air mixture in the combustion chamber, at the beginning of the fastener driving cycle, recoil forces often cause the tool to lift from the workpiece. In some cases, this recoil causes fasteners to be improperly or inaccurately placed. In other cases, the movement of the tool after ignition impedes accurate placement of subsequent fasteners.

Thus, there is a need for an improved nose assembly for a portable fastener driving tool that addresses one or more of the above-identified design issues of production and assembly cost, required precision for assembly, and maintenance and repair costs. In addition, there is a need for an improved nose assembly for a fastener driving tool that addresses the problem of tool lift during the fastener driving cycle.

BRIEF SUMMARY OF THE INVENTION

The above-listed needs are met or exceeded by the present nose assembly or nosepiece, which includes only two major components, as such reduces manufacturing costs and is less complicated to manufacture, assemble and repair compared to conventional nosepieces. A nosepiece body is securable to the tool and defines a fastener channel for receiving fasteners from the magazine and the driver blade from the power source. A unitary actuator reciprocates relative to the nosepiece and has a first portion with a workpiece contact surface and defining a fastener outlet chamber for slidingly accommodating the nosepiece body, and a second portion which directly engages the cage. Thus, the present nosepiece significantly reduces the components required for performing the cage actuation function. Also, the actuator is configured to remain in contact with the workpiece during fastener driving to more accurately guide the fasteners or pins into the workpiece as the nosepiece reciprocates relative to the actuator.

More specifically, in a fastener-driving tool equipped with a fastener magazine, a power source including a reciprocating driver blade for driving fasteners obtained from the magazine into a workpiece, and a reciprocating valve sleeve actuated by a cage, a nosepiece is provided, including a nosepiece body configured for attachment at one end to the fastener tool and defining a fastener channel constructed and arranged for receiving the driver blade and the fasteners sequentially fed by the magazine, the fastener channel having a fastener outlet. A unitary actuator reciprocates relative to the nosepiece body, has a first end contacting the workpiece, and a second end engaging the cage.

In another embodiment, in a fastener-driving tool equipped with a fastener magazine, having a power source including a reciprocating driver blade for driving fasteners obtained from the magazine into a workpiece, and a reciprocating valve sleeve actuated by a cage, a nosepiece is provided including a nosepiece body configured for attachment at one end to the fastener tool and defining a fastener channel constructed and arranged for receiving the driver blade and the fasteners sequentially fed by the magazine, the fastener channel having a fastener outlet. A unitary actuator reciprocally engages the nosepiece body and has a first end provided with a workpiece contact surface and a second end directly engaging the cage.

In yet another embodiment, an actuator is provided for use in a fastener-driving tool equipped with a fastener magazine, having a power source including a reciprocating driver blade for driving fasteners obtained from the magazine into a workpiece, a reciprocating valve sleeve actuated by a cage, and a nosepiece including a nosepiece body configured for attachment at one end to the fastener tool and defining a fastener channel constructed and arranged for receiving the driver blade and the fasteners sequentially fed by the magazine, the fastener channel having a fastener outlet. The actuator includes a first end provided with a workpiece contact surface, defining a fastener outlet chamber of sufficient length for accommodating reciprocal movement of the nosepiece body relative to the chamber throughout a fastener driving cycle and a tab for receiving a magazine follower to disable tool operation when a limited number of the fasteners remain in the magazine. A second end directly engages the cage end and defines a guide slot accommodating a guide fastener on the nosepiece body. The guide slot defines a reciprocating travel distance of the actuator relative to the nosepiece body, the travel distance corresponding to an amount of reciprocation associated with an entire fastener driving cycle.

DETAILED DESCRIPTION OF THE INVENTION

Figure 1:
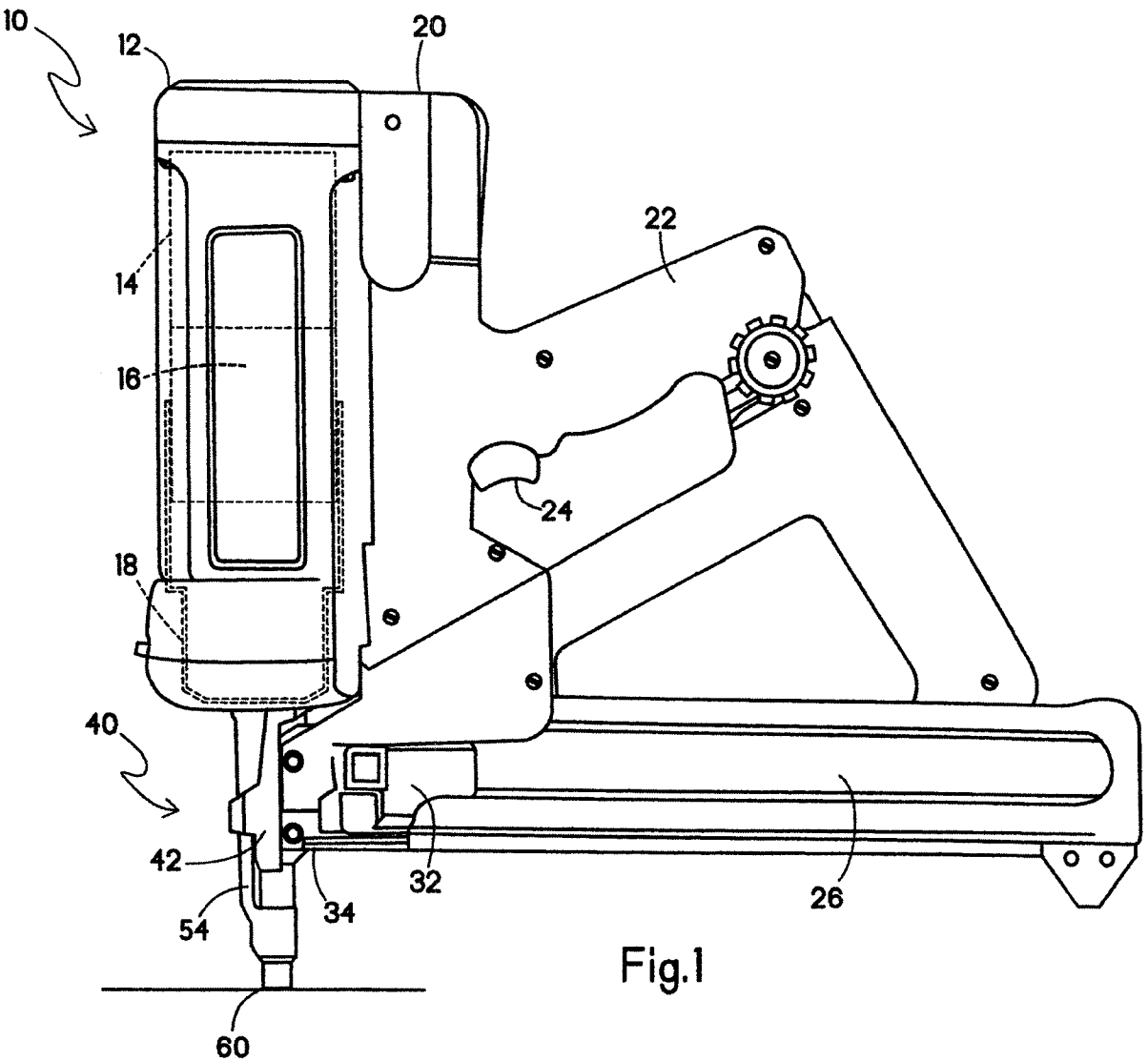
FIG. 1 is a side elevation of a fastener-driving tool equipped with the present nosepiece.

Referring now to FIG. 1, a fastener driving tool is designated generally at 10 and may be combustion-powered, pneumatic-powered or powder-activated; however, in the preferred embodiment a combustion-powered tool is depicted. Illustrated components of the tool 10 include a housing 12 enclosing a power source or engine 14 (shown hidden) which includes a reciprocating valve sleeve 16 moved by a cage 18 (FIG. 2) as is well known in the art. While a particular type of cage 18 has been depicted, it will be understood that the configuration of the cage may vary, and that it represents any structure which transfers linear motion from the actuator or WCE to the valve sleeve 16 for cyclically closing the combustion chamber. A fuel cell door 20 provides access to a fuel cell compartment housing a fuel cell (not shown) which provides fuel to the power source 14.

Included on the housing 12 is a handle 22 provided with a trigger or trigger switch 24 which initiates ignition in the power source 14. A magazine 26 retains a supply of fasteners 28 (FIG. 4), which may assume various shapes and types as known, but in the preferred embodiment are collated pins each inserted into a plastic sleeve 30 of the type described in commonly-assigned U.S. Pat. Nos. 6,641,021 and 6,892,922 which are incorporated by reference. The magazine 26 includes a spring-loaded follower 32 with a forward-projecting extension 34 which, when it engages a nose assembly or nosepiece 40 as described below, will indicate that only a few fasteners 28 remain in the magazine and will disable the tool 10, to prevent firing with an empty magazine.

Other components of the fastener-driving tool 10 are not critical to this invention and may be well known components of such a tool. Suitable combustion-powered, fastener-driving tools are available from ITW-Ramset (a unit of Illinois Tool Works, Inc.) of Glendale Heights, Ill., under its TRAK-FAST® trademark, into which these components can be readily incorporated. Such combustion-powered tools are similar to the tools disclosed in U.S. Pat. Nos. 4,403,722; 4,483,280; 4,483,474; 4,522,162; 5,263,439 and Re. 32,452; all of which are incorporated by reference.

Figure 2:
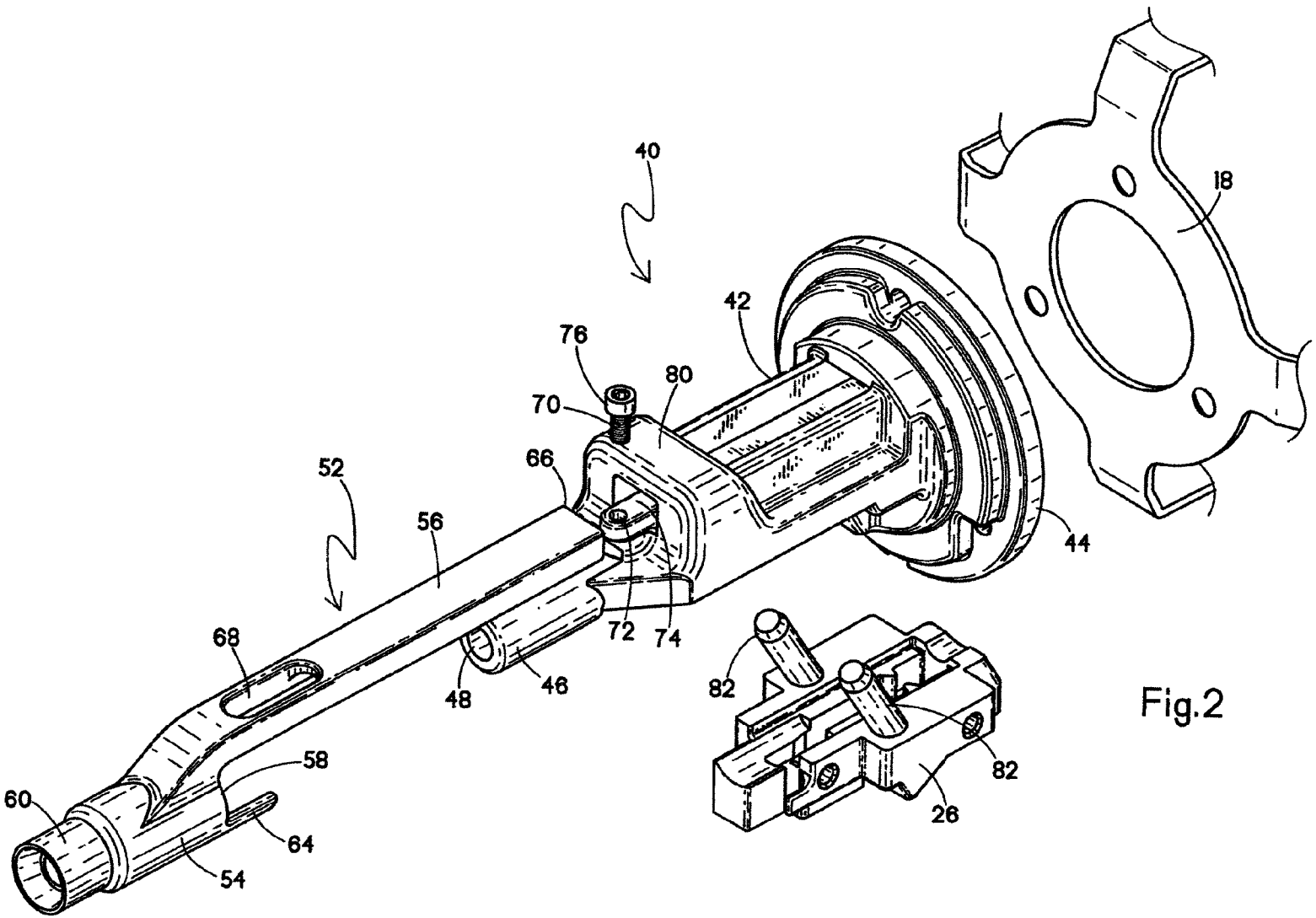
FIG. 2 is an exploded perspective view of the present nosepiece.
Figures 3, 4:
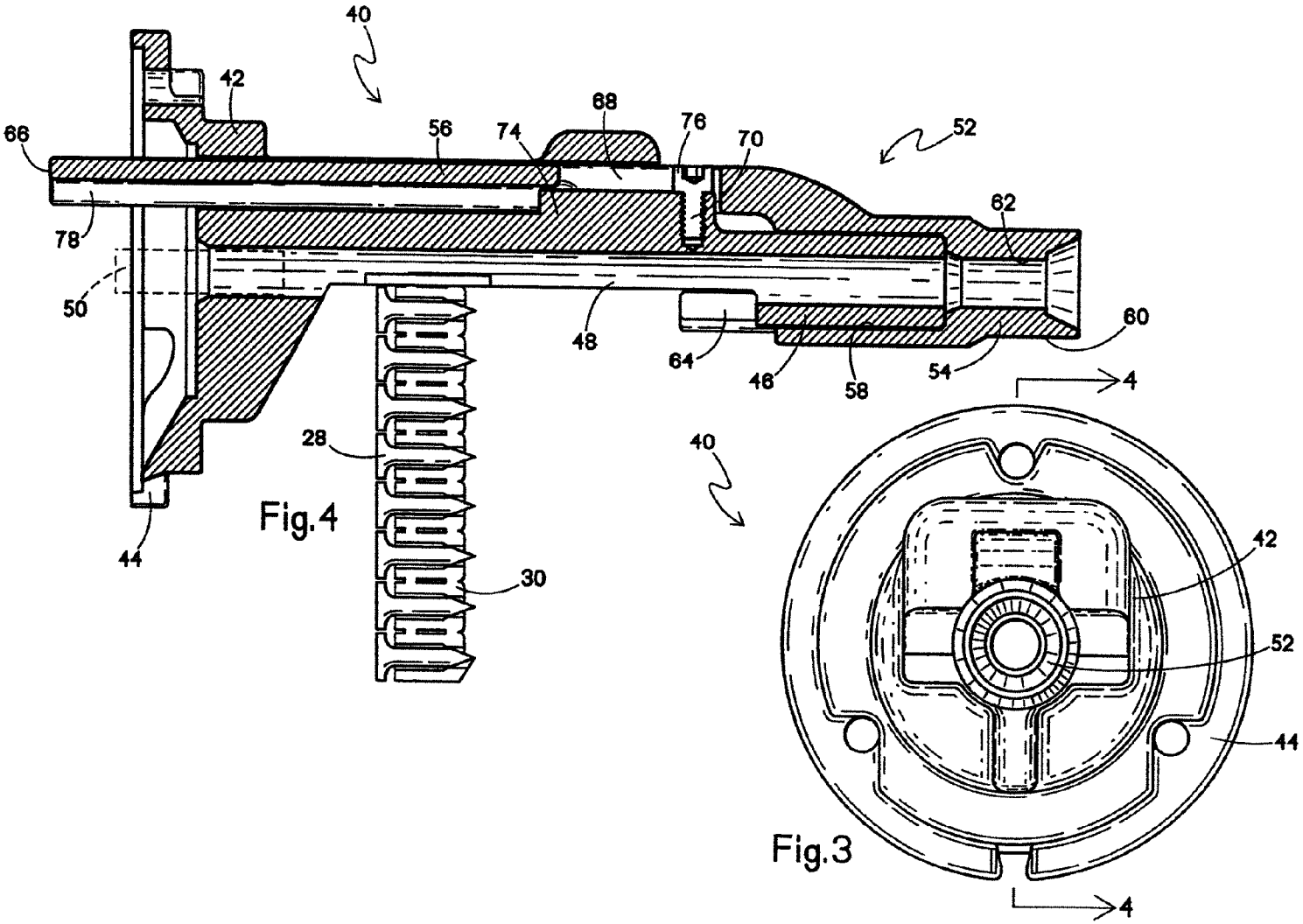
FIG. 3 is a bottom plan view of the present nosepiece.
FIG. 4 is a cross-section taken along the line 4-4 of FIG. 3 and in the direction generally indicated.
Figure 5:
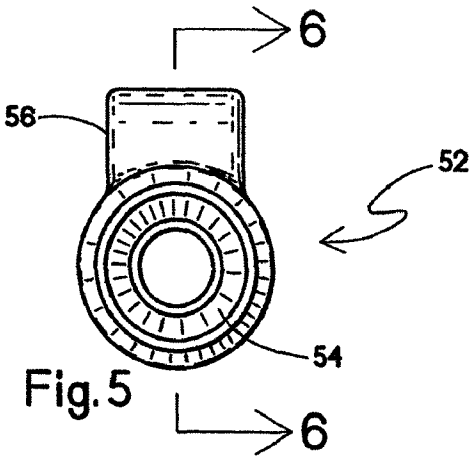
FIG. 5 is a bottom plan view of the present actuator.
Figure 6:
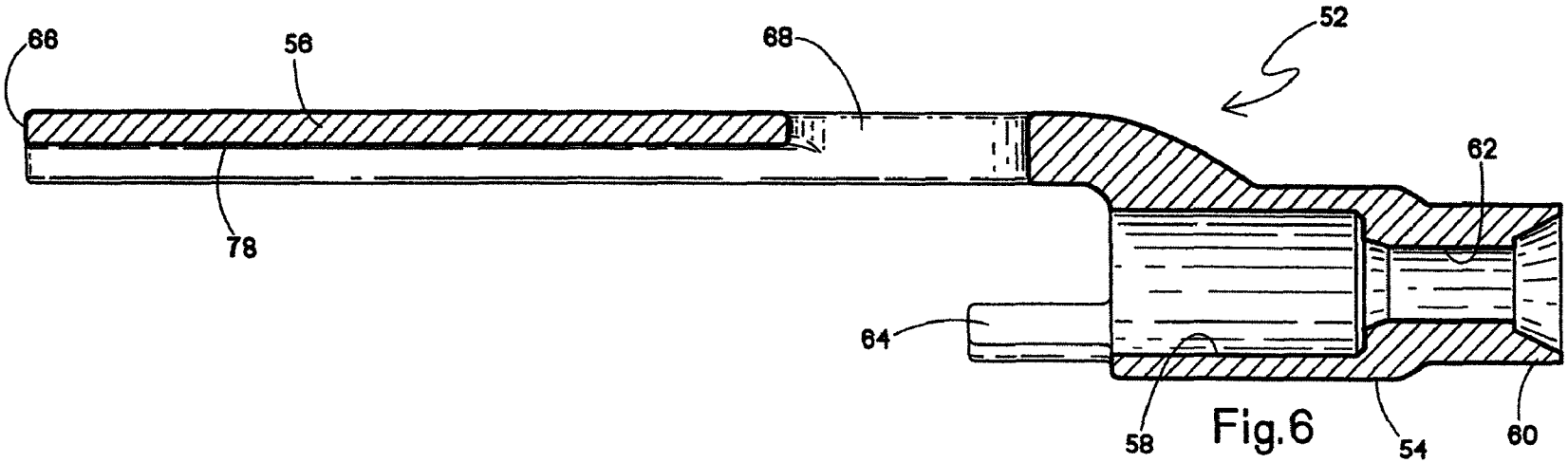
FIG. 6 is a cross-section taken along the line 6-6 of FIG. 5 and in the direction generally indicated.

Referring now to FIGS. 2-4, the nose assembly or nosepiece 40 includes a nosepiece body 42 configured for attachment at a flanged end 44 to the tool 10, and more preferably to a lower end of the power source 14. In the preferred embodiment, the nosepiece body 42 is a unitary member formed by casting and made of steel; however other metals or engineered materials and fabrication techniques are contemplated. Opposite the flanged end 44 is a generally tubular fastener outlet 46. Between the flanged end 44 and the fastener outlet 46 is defined a generally cylindrical fastener channel 48. The fastener channel 48 is dimensioned to slidingly accommodate a driver blade 50 (shown in phantom) from the power source 14, as well as a fastener 28 and the associated sleeve 30 sequentially fed from the magazine 26.

A second major component of the nosepiece 40 is an actuator 52 which reciprocates relative to the nosepiece. Features of the present actuator 52 include that it is preferably unitary and provides a direct connection between the workpiece and the cage 18. This unitary construction is relatively strong compared to conventional actuators, allows the elimination of components required in competitive nosepieces and accordingly increases operational reliability while reducing production and assembly costs. The actuator 52 is preferably cast from a metal such as steel, or equivalent metal; however forging, machining or other fabricating techniques are contemplated. This unitary construction is an advance over corresponding prior art structures, which were typically provided in multiple components secured together with fasteners and as such being more easily damaged and more tedious to repair and/or replace.

Another feature of the present actuator 52 is that it is constructed and arranged to accommodate reciprocal movement of the nosepiece body 42 during the fastener driving cycle. As such, once the user actuates the trigger 24 or otherwise initiates the fastener driving cycle, as the driver blade 50 drives the fastener 28 into the workpiece, inherent recoil forces cause the nosepiece body 42 to move upwardly away from the workpiece. In the present tool 10, the construction of the actuator 52 allows it to remain in position on the workpiece while the nosepiece body 42 slides and recoils relative to the actuator.

More specifically, and referring to FIGS. 3-6, the present actuator 52 includes a first end 54 contacting the workpiece, and a second end 56 engaging the cage 18. Included on the first end 54 are two main portions, a fastener outlet chamber 58 which slidingly and telescopingly engages the fastener outlet 46. The fastener outlet chamber 58 is provided with a sufficient axial length for accommodating the full reciprocal travel of the fastener outlet 46 during the fastener driving cycle, including recoil travel generated from combustion.

A second portion of the first actuator end 54 is a contact portion 60 which is constructed and arranged for contacting the workpiece. The contact portion 60 defines an internal fastener passageway 62 in communication with the fastener outlet chamber 58 as well as the fastener channel 48. As such, the fastener passageway 62 has the same internal diameter as the fastener channel 48 to enhance fastener guidance. In the preferred embodiment, the contact portion 60 has an optional relatively smaller exterior diameter than the portion of the first end 54 defining the fastener outlet chamber 58. Thus, the first actuator end 54 serves as a guide for fasteners or pins 28 being driven through the fastener outlet 46. As described above, actuator 52 remains in place on the workpiece after ignition and accommodates reciprocal movement of the nosepiece body 42 to provide post-combustion guiding of the fastener toward the workpiece.

Also preferably included on the first end 54 of the actuator 52 is a tab 64 projecting generally axially toward the cage 18. The tab 64 is configured for receiving the extension 34 of the magazine follower 32 to disable tool operation when a limited number of said fasteners remain in the magazine 26. As the number of fasteners in the magazine 26 decrease through use, the extension 34 moves gradually closer to the nosepiece 40. Contact between the extension 34 and the tab 64 prevents further reciprocation of the actuator 52 relative to the nosepiece body 42 and as such prevents tool firing until the magazine 26 is reloaded.

Referring now to the second actuator end 56, which is actually an elongate arm or rod sufficiently robust to directly contact the cage 18 and to overcome a spring biasing force acting on the valve sleeve 16 to move the valve sleeve, includes an upper tip 66 in direct contact with the cage 18. While other shapes are contemplated, the second end 56 is preferably rectangular in cross-section to provide a sufficient contact surface for actuating the cage 18, and also is preferably solid to withstand the significant shock impact forces generated during tool operation. A return spring (not shown) urges the actuator 52 away from the cage in a tool rest position. Prior to driving a fastener, the tool 10 is positioned relative to the workpiece so that the actuator contact portion 60 is aligned with the designated fastener placement point. The user then presses down on the handle 22, which causes the tip 66 to push the cage 18, compressing the spring as is known in the art. This movement closes the combustion chamber and initiates other tool functions related to combustion which are well known in the art and discussed in the patents made of record above.

To accommodate this reciprocal sliding of the actuator 52 relative to the nosepiece body 42, the second actuator end 56 defines an elongate guide slot 68 dimensioned to approximate the degree of relative travel of the nosepiece during the fastener driving cycle. A guide member 70, preferably a fastener is inserted into a preferably threaded aperture 72 in a guide lug 74 in the nosepiece body 42. While threaded engagement is preferred, other fastening technologies are contemplated, including welding, chemical adhesives, friction fitting, and the like. A head 76 of the member 70 is slidingly received in the guide slot 68 and serves as a stop for the relative reciprocal movement. The guide member 70 also retains the actuator upon the nosepiece body 42.

Positive sliding and aligned engagement between the actuator 52 and the nosepiece body 42 is also facilitated by the generally block-shaped guide lug 74. A rear surface 78 of the second actuator end 56 is formed into a generally "U"-shaped track that matingly and slidingly engages the guide lug 74. Also, the nosepiece body 42 preferably defines a bridge-like actuator retainer 80 which is also configured for supporting and enclosing blind end bores (not shown) accommodating locator pins 82 of the magazine 26 (FIG. 2) which facilitate location and engagement of the magazine 26 with the nosepiece 40.

Figure 11:
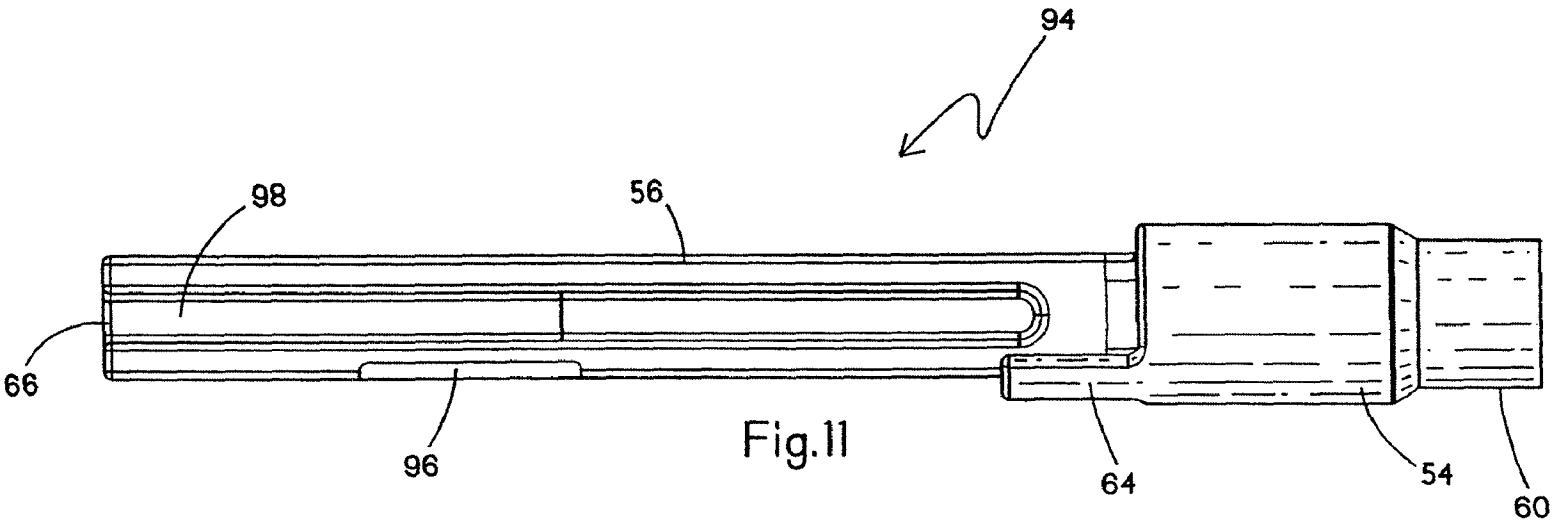
FIG. 11 is an elevational view of the actuator of FIG. 10.

Referring now to FIGS. 7-11, an alternate embodiment of the present nosepiece is generally designated 90. Components shared with the nosepiece 40 are designated with identical reference numbers. A main distinction of the nosepiece 90 is that a nosepiece body 92 lacks the guide lug 74. Another distinction is the modified actuator, generally designated 94. The guide slot 68 is eliminated, and has been replaced with a guide slot 96 which is located closer to the tip 66 than was the slot 68. In addition, the slot 96 is disposed in a slightly modified rear surface 98 of the second end 56 of the actuator 94. As seen in FIG. 11, to reduce weight and facilitate manufacturing, the rear surface 98 is provided with an elongate groove.

Figure 7:
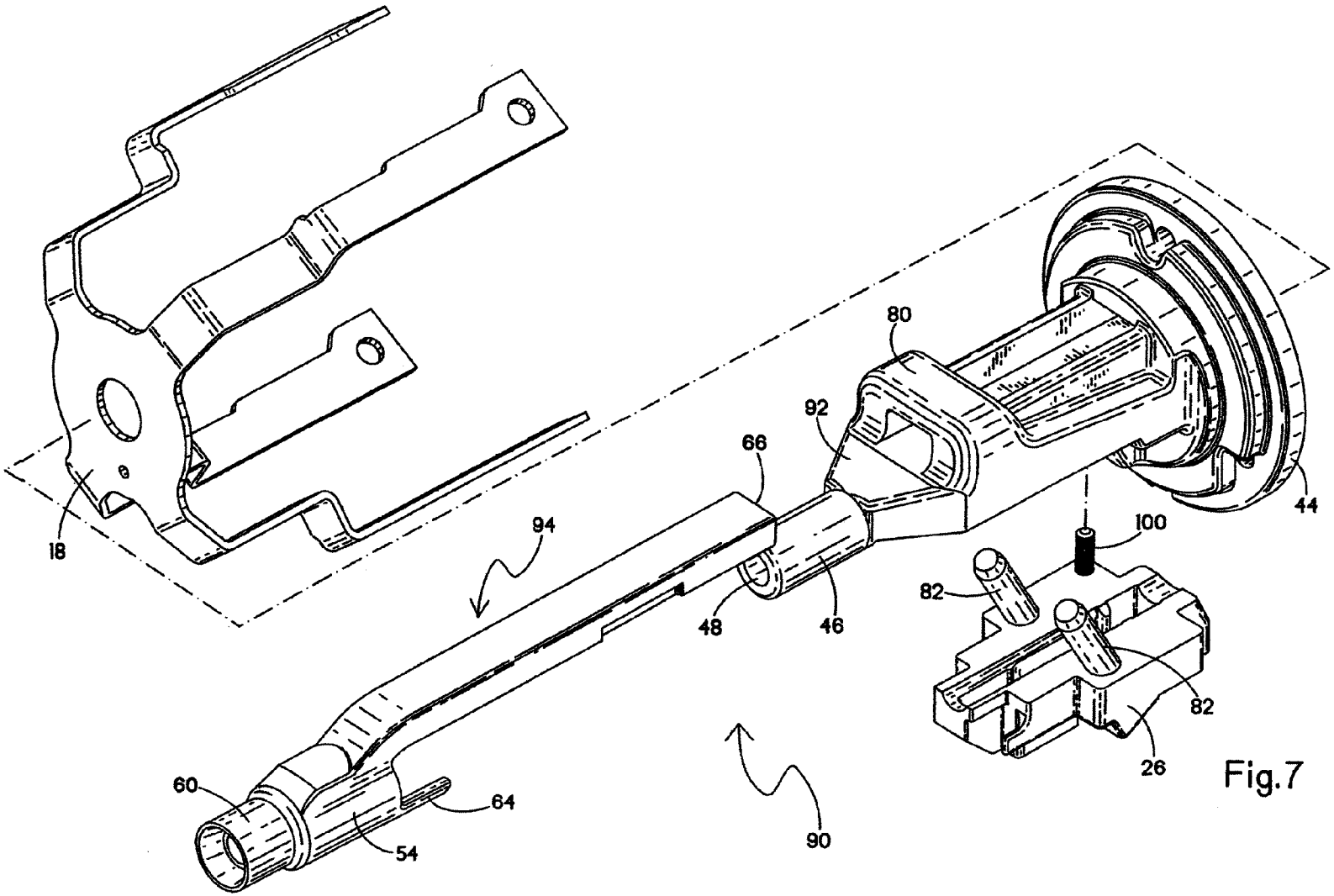
FIG. 7 is an exploded perspective view of an alternate embodiment of the present nosepiece.
Figure 8:
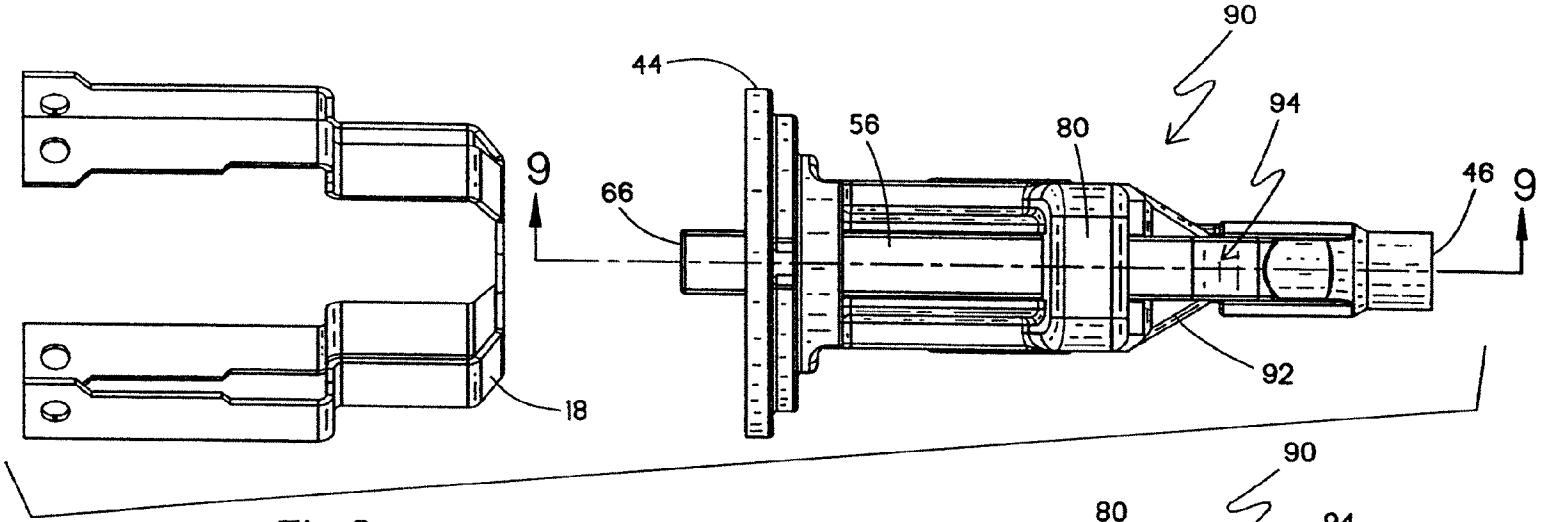
FIG. 8 is a front plan view of the nosepiece of FIG. 7.
Figure 9:
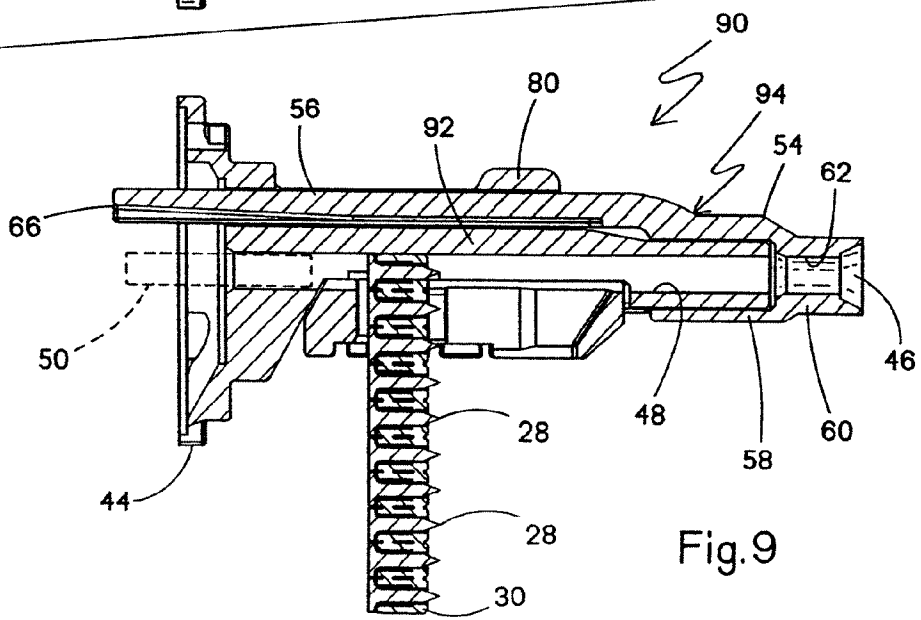
FIG. 9 is a cross-section taken along the line 9-9 of FIG. 8 and in the direction generally indicated.
Figure 10:
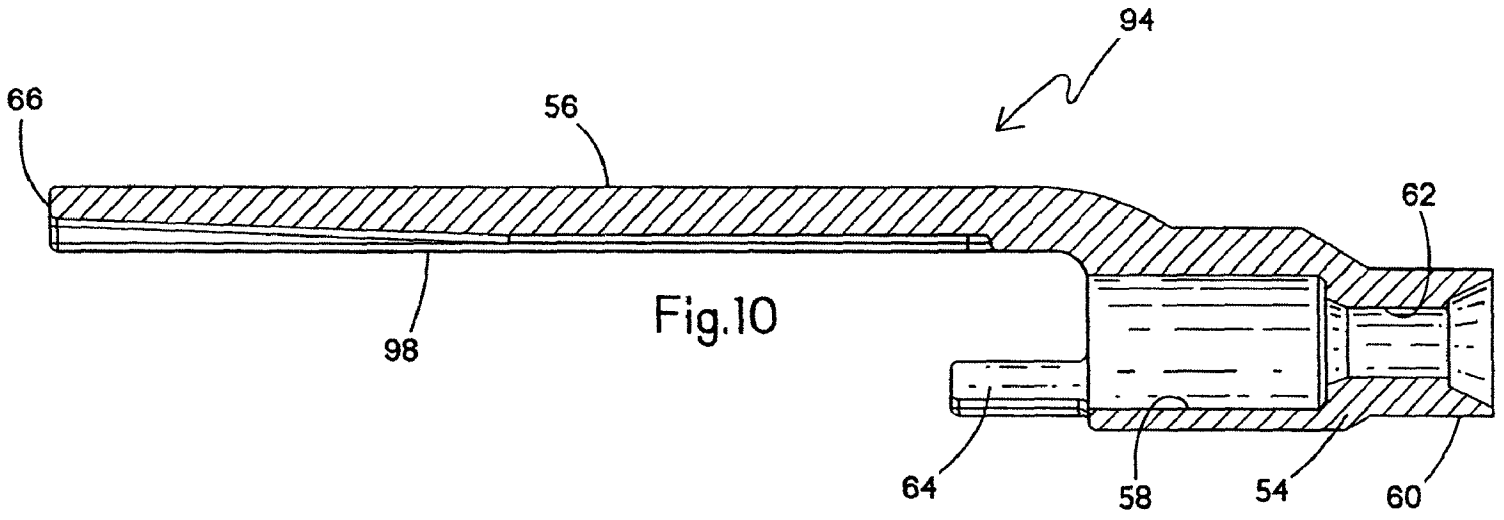
FIG. 10 is a vertical cross-section of the actuator of FIG. 7.

Using the modified design, the guide member 70 has been replaced by a headless guide member 100, preferably a setscrew which threadably engages the nosepiece 90, specifically the nosepiece body 92 from the direction of the insertion of the magazine 26 (FIG. 7). Upon installation, the guide member 100 is not visible from the front of the nosepiece 90 (FIG. 8). Once the setscrew 100 is fully installed, it engages the guide slot 96 for restraining the actuator 94 in its reciprocal travel in both directions relative to the nosepiece 90, and as such prevents the actuator from sliding out of the nosepiece. Due to this modification, the nosepiece 90 is lighter than the nosepiece 40 due to the absence of the guide lug 74. Also, due to the lack of the guide slot 68 extending through the second end 56, the second end 56 is relatively stronger. All other operational details of the nosepiece 90 correspond to the description of the nosepiece 40.

While specific embodiments of the present actuator pin guide for a fastener driving tool have been shown and described, it will be appreciated by those skilled in the art that changes and modifications may be made thereto without departing from the invention in its broader aspects and as set forth in the following claims.

What is claimed is:

1. In a fastener-driving tool equipped with a fastener magazine, having a power source including a reciprocating driver blade for driving fasteners obtained from the magazine into a workpiece, and a reciprocating valve sleeve actuated by a cage, a nosepiece comprising:

a nosepiece body configured for attachment at one end to the fastener-driving tool and defining a fastener channel constructed and arranged for receiving the driver blade and the fasteners sequentially fed by the magazine, said fastener channel having a fastener outlet; and a unitary actuator reciprocating relative to said nosepiece body, having a first end contacting the workpiece, and a second end engaging the cage; and a guide member engaged in said nosepiece body, said actuator defining a guide slot slidingly engaging said guide member, wherein said guide slot defines a length corresponding to a distance of reciprocal travel of said actuator relative to said nosepiece body.

2. The nosepiece of claim 1 wherein said first actuator end engages said fastener outlet, and defines a fastener passageway in communication with said fastener channel and having a matching internal diameter.

3. The nosepiece of claim 2 wherein said actuator first end telescopingly engages said fastener outlet.

4. The nosepiece of claim 3 wherein said actuator first end defines a fastener outlet chamber of sufficient length for accommodating reciprocal movement of said nosepiece body relative to said chamber throughout a fastener driving cycle.

5. The nosepiece of claim 1 wherein said actuator first end has a relatively larger diameter portion defining a fastener outlet chamber configured for slidingly accommodating said fastener outlet of said nosepiece body, and a relatively smaller diameter contact portion having a fastener passageway in communication with said fastener outlet chamber.

6. The nosepiece of claim 1 wherein said guide member is a fastener having an end which engages said guide slot upon engagement in said nosepiece.

7. The nosepiece of claim 1 wherein said second end of said actuator directly engages said cage.

8. The nosepiece of claim 1 wherein said nosepiece body includes a guide lug, and said second end of said actuator defines a track for slidably engaging said guide lug.

9. The nosepiece of claim 8 wherein said track is generally "U"-shaped.

10. The nosepiece of claim 1 wherein said nosepiece body defines an actuator retainer for holding said actuator along a fixed axis throughout the course of reciprocation of said actuator.

11. In a fastener-driving tool equipped with a fastener magazine, having a power source including a reciprocating driver blade for driving fasteners obtained from the magazine into a workpiece, and a reciprocating valve sleeve actuated by a cage, a nosepiece comprising:

a nosepiece body including a guide lug and configured for attachment at one end to the fastener-driving tool and defining a fastener channel constructed and arranged for receiving the driver blade and the fasteners sequentially fed by the magazine, said fastener channel having a fastener outlet;

a unitary actuator reciprocally engaging said nosepiece body, said actuator defining a guide slot and having a first end provided with a workpiece contact portion and a second end directly engaging the cage, said guide slot having a length corresponding to a relative reciprocal travel of said actuator to said nosepiece body in a fastener driving cycle, said first end including a tab projecting axially toward the cage for receiving a magazine follower to disable tool operation when a limited number of the fasteners remain in the magazine, and said second end defining a track for slidingly engaging said guide lug; and a guide member engaged in said nosepiece body, said guide member being a fastener configured to slidingly engage said guide slot upon engagement in said nosepiece body.

12. The nosepiece of claim 11 wherein said first end defines a fastener outlet chamber of sufficient length for accommodating reciprocal movement of said nosepiece body relative to said chamber throughout a fastener driving cycle.

13. The nosepiece of claim 11 wherein said nosepiece body defines an actuator retainer for retaining said second actuator end along a fixed axis throughout a course of reciprocation of said actuator.

14. An actuator for use in a fastener-driving tool equipped with a fastener magazine, having a power source including a reciprocating driver blade for driving fasteners obtained from the magazine into a workpiece, a reciprocating valve sleeve actuated by a cage, and a nosepiece including a nosepiece body configured for attachment at one end to the fastener tool and defining a fastener channel constructed and arranged for receiving the driver blade and the fasteners sequentially fed by the magazine, the fastener channel having a fastener outlet, said actuator comprising:

a first end provided with a workpiece contact portion, defining a fastener outlet chamber of sufficient length for accommodating reciprocal movement of the nosepiece body relative to said chamber throughout a fastener driving cycle and a tab extending axially from said first end for receiving a magazine follower to disable tool operation when a limited number of the fasteners remain in the magazine; and a second end directly engaging the cage and defining a guide slot accommodating a guide member on the nosepiece body, said guide slot defining a reciprocating travel distance of said actuator relative to the nosepiece body, said travel distance corresponding to an amount of reciprocation associated with an entire fastener driving cycle.

15. The actuator of claim 14, wherein a rear surface of said second end has an axially extending, U-shaped track in communication with said guide slot.

* * * * *